US010094627B2

(12) United States Patent
Heine et al.

(10) Patent No.: US 10,094,627 B2
(45) Date of Patent: Oct. 9, 2018

(54) TUBE SHEET WITH BASE REGION HAVING WEBS AND BEADS BETWEEN ADJACENT TUBE OPENINGS

(71) Applicant: MAHLE International GmbH, Stuttgart (DE)

(72) Inventors: Reinhard Heine, Leutenbach (DE); Hicham Rouhana, Korntal-Muenchingen (DE); Thomas Strese, Schwaikheim (DE); Uwe Fritsche, Remseck am Neckar (DE)

(73) Assignee: MAHLE International GmbH, Stuttgart (DE)

( * ) Notice: Subject to any disclaimer, the term of this patent is extended or adjusted under 35 U.S.C. 154(b) by 98 days.

(21) Appl. No.: 15/061,422

(22) Filed: Mar. 4, 2016

(65) Prior Publication Data

US 2016/0187077 A1 Jun. 30, 2016

Related U.S. Application Data

(63) Continuation of application No. PCT/EP2014/067844, filed on Aug. 21, 2014.

(30) Foreign Application Priority Data

Sep. 4, 2013 (DE) ..... 10 2013 217 689

(51) Int. Cl.
*F28F 9/02* (2006.01)
*F28F 1/00* (2006.01)
*F28F 9/18* (2006.01)

(52) U.S. Cl.
CPC ..... *F28F 9/0229* (2013.01); *F28F 1/00* (2013.01); *F28F 9/0226* (2013.01); *F28F 9/182* (2013.01); *F28F 2225/08* (2013.01)

(58) Field of Classification Search
CPC ..... F28F 9/0226; F28F 2225/08; F28F 9/182; F28F 9/0229

(Continued)

(56) References Cited

U.S. PATENT DOCUMENTS 5,664,625 A * 9/1997 Letrange ..... F28F 9/02 165/149
8,074,708 B2 * 12/2011 Sugito ..... F28D 1/05366 165/173

(Continued)

FOREIGN PATENT DOCUMENTS

CN 101097122 A 1/2008
CN 101107492 A 1/2008

(Continued)

OTHER PUBLICATIONS

Translation of FR 2270471 A1 entitled Translation-FR 2270471 A1.*

*Primary Examiner* — Len Tran
*Assistant Examiner* — Paul Alvare
(74) *Attorney, Agent, or Firm* — Muncy, Geissler, Olds & Lowe, P.C.

(57) ABSTRACT

A tube sheet having a circumferential edge region for connection to a lid of a collecting tank and having a base region with openings for receiving tube ends, the base region having webs provided between adjacent openings, the webs connecting the portions of the edge regions situated on the opposite longitudinal sides, at least one bead being provided which extends along the edge region and/or from the edge region with a limited extension only into a portion of a web.

12 Claims, 3 Drawing Sheets

(58) Field of Classification Search
USPC ..... 165/173
See application file for complete search history.

(56) References Cited

U.S. PATENT DOCUMENTS

| | | | | |
|---|---|---|---|---|
| 2006/0254761 | A1* | 11/2006 | Watanabe | B23K 1/0012 165/173 |
| 2008/0078540 | A1 | 4/2008 | Loewe et al. | |
| 2009/0255657 | A1* | 10/2009 | Hakamata | B23P 15/26 165/178 |
| 2015/0168080 | A1 | 6/2015 | Honma et al. | |

FOREIGN PATENT DOCUMENTS

| | | | | |
|---|---|---|---|---|
| CN | 102575915 | A | 1/2008 | |
| CN | 102753928 | A | 10/2012 | |
| DE | 10 2006 005 421 | A1 | 8/2006 | |
| FR | 2 270 471 | A1 | 12/1975 | |
| FR | 2270471 | A1 * | 12/1975 | F28D 1/0535 |
| FR | 2 952 711 | A1 | 5/2011 | |
| JP | 2004-301455 | A | 10/2004 | |
| WO | WO 2014/013725 | A1 | 1/2014 | |

* cited by examiner

TUBE SHEET WITH BASE REGION HAVING WEBS AND BEADS BETWEEN ADJACENT TUBE OPENINGS

This nonprovisional application is a continuation of International Application No. PCT/EP2014/067844, which was filed on Aug. 21, 2014, and which claims priority to German Patent Application No. 10 2013 217 689.9, which was filed in Germany on Sep. 4, 2013, and which are both herein incorporated by reference.

BACKGROUND OF THE INVENTION

Field of the Invention

The invention relates to a tube sheet having a circumferential edge region for connection to a cover of a collecting tank and having a base region with openings for accommodating tube ends, the base region having webs provided between adjacent openings, wherein the webs connect the portions of the edge region situated on mutually opposite longitudinal sides.

Description of the Background Art

Heat exchangers with a tube-rib design generally have a collecting tank from a box-like cover and a tube sheet. The tube sheet has a number of openings which accommodate the tubes of the heat exchanger.

Among other things, due to thermal loads and fluctuations in pressure, the collecting tanks experience strong mechanical loads which act in particular on the tube sheet and therefore also on the tubes accommodated in the tube sheet. This leads to a negative effect on the tubes and the tube sheet, which overall reduces durability of the tube sheet and thus of the heat exchanger.

In the prior art, solutions are known which provide reinforcing elements on the tube sheet, which absorb the mechanical loads or counteract them.

For example, the publication DE 10 2006 005 421 A1 discloses an arrangement of cams in the tube sheet of a heat exchanger. The cams serve as an abutment for a cover that can be inserted in the tube sheet. In particular, they counteract an inward deflection of the cover. The cams are thereby particularly advantageous as they are molded upwards, i.e. away from the heat exchange network and towards the cover, thus forming a stop for the cover. In this way, the forces acting from the outside on the cover, which, for example, are produced by the connection between the tube sheet and the cover, can be greater. By such a design, a circumferential bead for accommodating the cover and/or a seal may be omitted, whereby the heat exchanger can particularly be constructed to be narrower.

A disadvantage of the solutions according to the prior art is that the reinforcing elements provided on the tube sheets are not optimally designed and not optimally arranged on the tube sheets to be able to counteract a deformation of the tube sheet and thus ensure sufficient load relief for the accommodated tubes.

SUMMARY OF THE INVENTION

It is therefore an object of the invention to provide a tube sheet having a reinforcement and thus being more robust in the face of occurring mechanical and thermal loads. Furthermore, it is the object to provide a heat exchanger having at least one inventive tube sheet.

An embodiment of the invention relates to a tube sheet having a circumferential edge region for connection to a cover of a collecting tank and having a base region with openings for accommodating tube ends, the base region having webs provided between adjacent openings, the webs connecting the portions of the edge region situated on mutually opposing longitudinal sides, at least one bead being provided which extends along the edge region and/or from the edge region with a limited extension only into a portion of a web.

By including one or more beads, the stability of the tube sheet can overall be increased. This is advantageous as this way, the durability of the tube sheet can be increased and thus also the durability of the entire heat exchanger. It is particularly advantageous if the beads are arranged at the webs in the edge region or adjacent to the edge region, as it is there that the greatest loads occur during operation.

The edge region can have a U-shaped cross-section having a first wall, a second wall and a base, wherein the first wall is arranged facing the webs.

A U-shaped cross-section of the edge region is advantageous as this way, a receiving area for the base of a cover of a collecting tank and possibly a seal is formed by the shape of the edge region.

The openings can be designed in the manner of slots and extend parallel to one another.

The slot-like openings are advantageous as generally flat tubes are used which are inserted into the openings. A parallel arrangement of the individual openings to one another facilitates the production of the tube sheet and the mounting of the heat exchanger.

The openings each can have an at least partially circumferential wall, which extends from the base region in the direction of the open end region of the U-shaped edge region.

These at least partially circumferential walls form so-called passages. The passages increase the stability of the tube sheet. In addition, they create a greater contact surface between the tube and the tube sheet, which in particular benefits the durability of the connection between the tube and the tube sheet.

The circumferential walls can have bevels at their longitudinal end regions facing the first wall of the U-shaped edge region.

The bead can be molded into the tube sheet from above, from the direction of the open U-shaped edge region.

In this way, the bead is molded downwards towards the tubes that are later accommodated in the openings. This increases the stability of the tube sheet. Embodiments of the bead which are molded into the tube sheet completely or partially from above and/or from below may also be provided.

In addition, the bead can extend from the first wall to the web.

Having the bead extend from the first wall that faces the web to the web is particularly advantageous as this way, the bead creates a particularly well-reinforced web of the tube sheet.

It is also expedient if on at least one of the webs, in each case a bead is arranged at the two end regions of the web mutually opposite one another. A plurality of beads is particularly favorable for the stability of the tube sheet.

It is also expedient if the depth of the bead decreases with increasing distance from the respective, first wall of the edge region.

Such a design is easily implemented from a manufacturing point of view and also has the advantage that the material thinning at the web edges, which occurs as a result of the bead impression, is kept as minimal as possible.

An embodiment may provide that the first wall of the edge region has a portion angled towards the webs, wherein the angled portions situated mutually opposite one another are connected by a planar portion of the web.

The angled portion of the wall increases the stability of the tube sheet. Additional beads in this angled portion further increase the stability. Such a design is particularly advantageous as the beads in the angled portions are particularly easy to manufacture.

The bead can extend from the angled portion of the first wall to the planar portion of the web, along the angled portion.

The bead can extend beyond the angled portion into the planar portion of the web.

An extension of the bead into the web can further increase stability. The area of increased stability is thereby expanded from the edge region to the webs, which is overall conducive to an improved durability of the tube sheet.

It is also expedient if in the area of the first wall the bead has an extension, which extends in one direction, transversely to the main extension direction of a web, beyond the web extension. With a broader design of the bead, the bead can provide greater stability.

The maximum interior depth of a bead can be determined by the maximum material deflection from the planar base region, minus the applied material thickness.

An embodiment relates to a heat exchanger having a plurality of tubes which are accommodated in at least one inventive tube sheet.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
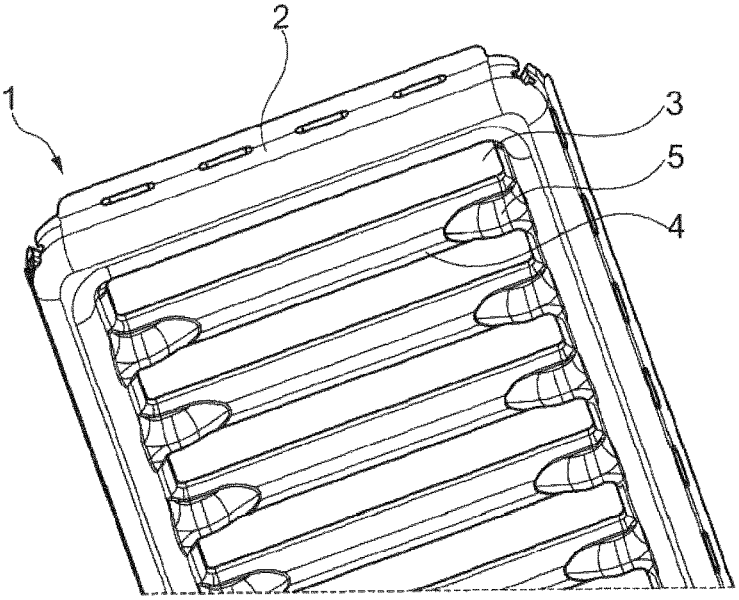
FIG. 1 is a perspective view of a tube sheet, wherein beads which extend towards the center of the webs are arranged in the transitional areas between the webs, which space the openings apart, and the edge region.

FIG. 1 shows a perspective view of a tube sheet. The tube sheet 1 has a circumferential edge region 2. This edge region 2 comprises a base region having a plurality of adjacent openings arranged relative to one another. The openings 3 are separated relative to one another by webs 4 which connect the longitudinal portions of the edge region 2. The base region of the tube sheet 1 is thereby substantially designed flat and planar. The webs 4 are molded from this flat base region by means of a reforming process. The openings 3 may also have passages not shown in FIG. 1, which are also molded from the flat, planar base region.

At the ends facing the edge region, the webs 4 each have a bead 5. This bead 5 extends from the end region through at least one portion of the web 4 to the center of the web 4. The depth of the bead 5 decreases towards the center of the web 4, starting from the edge region 2.

Furthermore, in each case the beads 5 at the webs 4 have an extension transverse to the main extension direction of the webs 4, which is greater than the extension of the webs 4 in this direction. The edge region 2 of the beads 5 thus project beyond the webs 4, in particular in the contact region in a direction transverse to the main extension direction of the webs 4.

Figure 2:
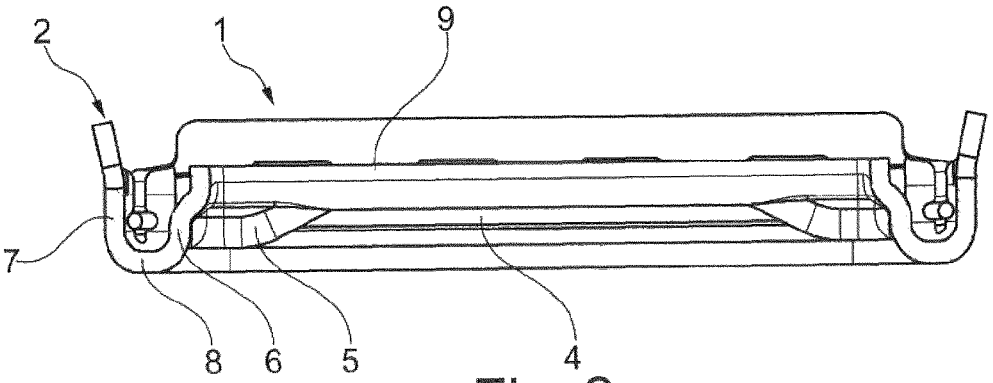
FIG. 2 is a sectional view of a tube sheet according to FIG. 1, wherein the cross section extends along the main extension direction of the webs and the cross sectional plane passes through one of the openings.

FIG. 2 shows a sectional view through the tube sheet 1 shown in FIG. 1. The cross section thereby extends along the main extension direction of the webs 4 or the openings 3. The sectional plane of FIG. 2 extends through one of the openings 3.

In FIG. 2 it can be seen that the edge region 2 has a U-shaped cross-section, wherein the U-shaped cross-section can be formed by a first wall 6, a second wall 7 situated substantially parallel to this first wall 6, and a base 8, which connects the walls 6 and 7 to one another. The U-shaped edge region 2 forms a receiving area for a sealing element or for the base of a cover of a collecting tank. Wherein the sealing element and the cover of the collecting tank may be inserted from above into the tube sheet.

The edge region 2 or in particular the second wall 7, which is oriented outwards, has in its upper region a portion that is angled outwards. After application of a not-shown cover of a collecting tank, this portion serves for fixating the base of the cover within the receiving area in the tube sheet 1.

The reference numeral 9 denotes a passage which extends the opening 3 upwards, starting from the flat, planar base region of the tube sheet 1. The passage 9 thereby forms a contact surface for the tube ends, which can be inserted in the openings 3. In this way, in particular the contact surface between the tube sheet 1 and the not-shown tube is increased, whereby a more stable connection can be created, for example, by means of a soldering process.

In FIG. 2 it can be seen that each web 4 has a bead 5 positioned at its two end regions, which in each case face the first wall 6 of the edge region 2. The bead 5 thereby exhibits its maximum depth in the area of the first wall 6 and extends in the direction of the center of the tube sheet 1 with a depth that initially remains constant. After a certain extension of constant depth, the bead 5 depth continuously decreases until it eventually completely merges into the web 4 or the base region of the tube sheet 1. The bead 5 path hereby is exemplary. In alternative embodiments, a different path can also be provided, wherein for example the bead may extend further into the center of the tube sheet.

In FIG. 2 it can also be seen that the first wall 6 has two wall portions relative to one another by means of a fold. The bead 5 thereby substantially projects from the lower portion of the first wall 6. The upper portion of the first wall 6 forms the longitudinal delimitation of the opening 3.

Figure 3:
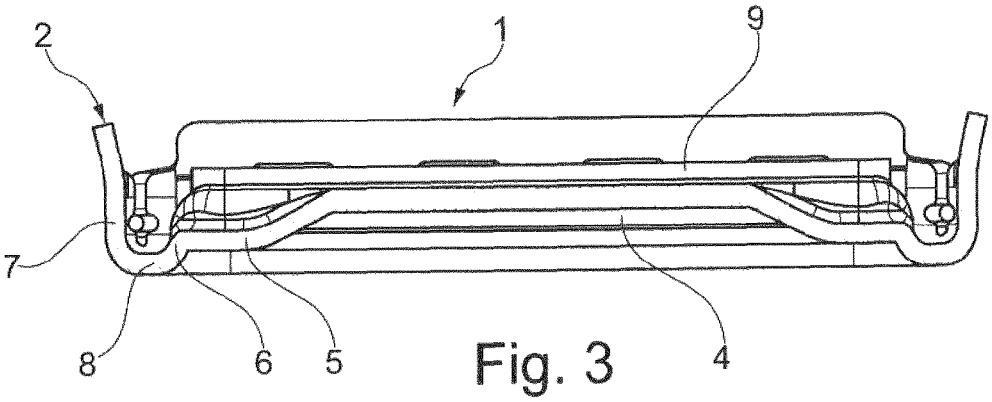
FIG. 3 is a sectional view according to FIG. 2, wherein the cross sectional plane passes through one of the webs.

FIG. 3 shows a further sectional view through the tube sheet 1 that was already shown in FIGS. 1 and 2. In contrast to FIG. 2, the cross section extends through one of the webs 4.

In FIG. 3 it can be seen that through the two beads 5 arranged at the ends of the webs 4 and through the web 4 portion of the tube sheet 1 centered between the beads 5, the tube sheet 1 has a configuration which substantially forms three planes. The base 8 of the edge region 2 hereby forms the lower plane, the region of constant depth of the bead 5 forms the center plane and the area of the web 4 corresponding to the base region forms the upper plane. The planes are thereby each connected to one another by transversely extending transitions.

In alternative embodiments, the bead can also be further drawn into the web, towards the center of the tube sheet. Similarly, the pitch angles or depths of the bead can deviate in the individual regions. In a further alternative embodiment, the web could be positioned lower or higher, relative to the planar base region of the tube sheet. A lowering of the web relative to the original base region can thereby advantageously occur by a stamping.

As can be seen in FIGS. 2 and 3, the beads 5 are advantageously molded into the tube sheet 1 by a stamping process. A tool is thereby advantageously driven from above from the direction of the open, U-shaped edge region 2 into the tube sheet 1 in such a way, that the beads, as they are illustrated in FIGS. 1 to 3, are molded. This stamping of the beads can advantageously occur in one operation during the molding of the edge region 2.

As an alternative to the embodiments of the bead 5 as it is shown in FIGS. 1 to 3, an embodiment is possible in which with increasing distance from the first wall 6, the depth of the bead increases, stays constant or decreases. To this end, areas of the increasing depth, the constant depth or the decreasing depth may be randomly arranged adjacent to one another.

Figure 4:
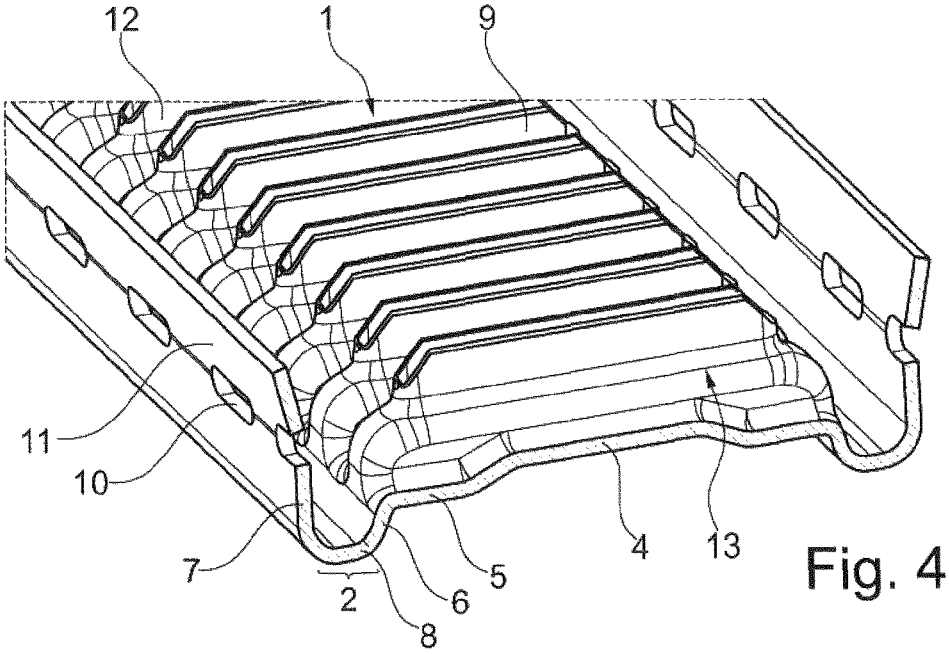
FIG. 4 is a further perspective view of a tube sheet, wherein the view from above is oriented towards the passages and the webs of the tube sheet.

FIG. 4 shows a further perspective view of a tube sheet. FIG. 4 particularly demonstrates that by means of the bead arrangement at the end-side regions of the webs 4, a shaping is created in which the contour of the beads 5 or the web 4 extend below the original base region of the tube sheet 1. The bead 5 as well as the web 4 are thereby deflected below the starting level of the base region. The passages 9 are formed upward, above the base region and are arranged as an extension of the openings 3. The passages 9 shown in FIG. 4 have bevels 12 at their longitudinal end regions.

As compared to the path of the web 4 or the beads 5, the areas of the tube sheet 1 which have openings 3 or passages 9 are molded in an elevated manner and project beyond the openings or passages. By stamping the beads 5, the tube sheet 1 is reinforced in particular in the area of the first wall 6 of the edge region 2.

In FIG. 4 it can further be seen that the second wall 7 has a perpendicular, lower region and an upper region 11 that is angled outward. Along the folded line between the lower region and the upper region 11, several slot-like openings 10 are provided. These serve to produce a corrugated slot flange between the tube sheet 1 and a cover of a collecting tank that can be inserted into the tube sheet 1, a variety of which are known in solutions from the prior art.

The passages 9 are designed in elevated areas 13, which are raised in particular relative to the beads 5 and the web 4. These elevated areas 13 are substantially formed by the stamping of the beads 5 and possibly by the stamping of a recess in the web 4 region. The elevated areas 13 thereby project beyond the original level of the base region or are positioned on the same level, whereas the beads 5 or the web 4 are arranged below the original level of the base region.

In an alternative embodiment, the elevated areas may be higher or lower or can be completely omitted, so that the passages with the webs can be positioned on one level.

Figure 5:
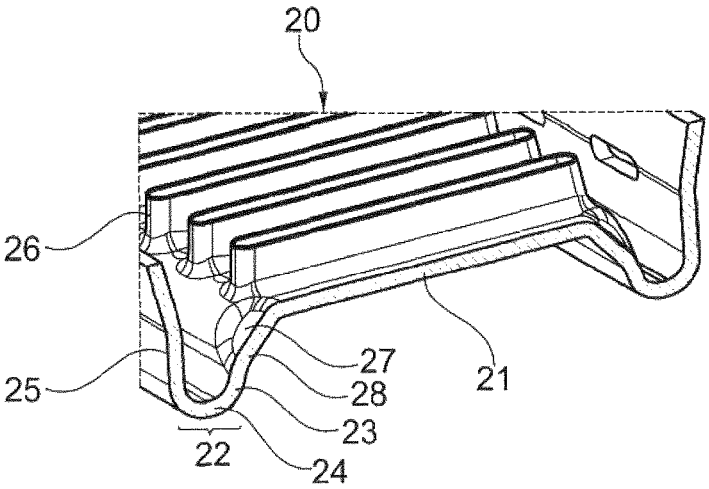
FIG. 5 is a perspective partial view of an alternative embodiment of a tube sheet, the edge region having a portion angled towards the center of the tube sheet, which has a bead.

FIG. 5 shows a view of an alternative tube sheet 20. The tube sheet 20 also has a plurality of openings which form passages 26 that are oriented upward. The openings or passages 26 are spaced apart from each other by webs 21, wherein the webs 21 are formed in a planar manner and form the base region of the tube sheet 20. The passages 26 are deflected out of this base region by means of a reforming process.

Furthermore, the circumferential edge region 22 has a first wall 23 facing the webs 21, a second wall 25 and a base 24 which connects the first wall 23 with the second wall 25. Connected to the portion of the first wall 21 extending in a substantially perpendicular manner is a portion 28 angled towards the center of the tube sheet 20. The angled portions 28 situated opposite one another are also connected to one another by the web 21 extending in a planar manner.

For reinforcement of, in particular, the edge region 22 or the first wall 23 and the angled portion 28, by way of example, a bead 27 is arranged in FIG. 5 which extends along the angled portion 28.

The bead 27 is thereby inserted into the angled portion 28 by means of a shaping tool, for example by a stamping process from above. The bead 27 thereby extends at least through the full width of the web 21 in a direction transverse to the main extension direction of the web 21. Furthermore, the bead 27 can also extend through the width of the web 21 and in particular through the length of the angled portion 28 into the web 21.

As illustrated in FIG. 5, advantageously a bead 27 is arranged at each of the two mutually opposing angled portions 28.

Figure 6:
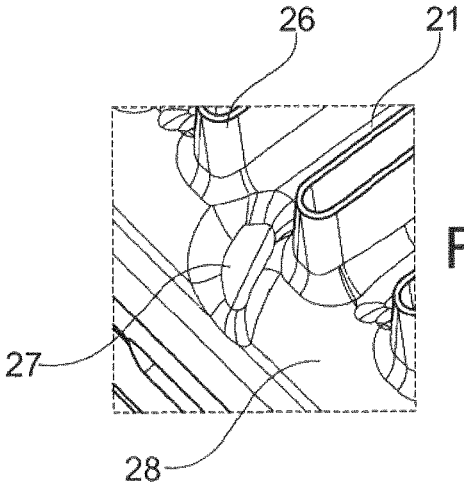
FIG. 6 is a detailed view of the angled portion according to FIG. 5.

FIG. 6 shows a detailed view of the tube sheet 20, wherein in particular the bead 27 is shown between two passages 26 that are arranged adjacent to one another. It can be seen that the bead 27 has an elongated configuration, wherein the center line of the bead 27 communicates with the center line extending between the passages 26 of the web 21. As can be seen in FIG. 6, the bead 27 width can also extend beyond the width of the web 21. The width of the web 21 is thereby the extent of the web 21 between passages 26 that are positioned adjacent to one another.

The bead 27 extends as shown in FIGS. 5 and 6 from the angled portion between the first wall 23 and the angled portion 28 to the planar region of the web 21. In alternative embodiments, the bead 20 can also be further drawn into the web 21. For example, it would be possible to combine the beads in FIGS. 1 to 4 with the tube sheet in FIG. 5 or 6.

The beads 27 of FIGS. 5 and 6, in particular situated in the angled portions 28 of the first wall 23, can increase the stability of the entire tube sheet 20. In particular, the edge region 22 can be reinforced in this way. This is particularly favorable as in this area, the greatest mechanical loads are created due to fluctuations in pressure and movements inside the heat exchanger. Thus, the design of the beads 27 makes the tube sheet 20 more robust, which in turn encourages longer durability. A similar effect is created by the beads 5 shown in FIGS. 1 to 4 on the tube sheet.

Figure 7:
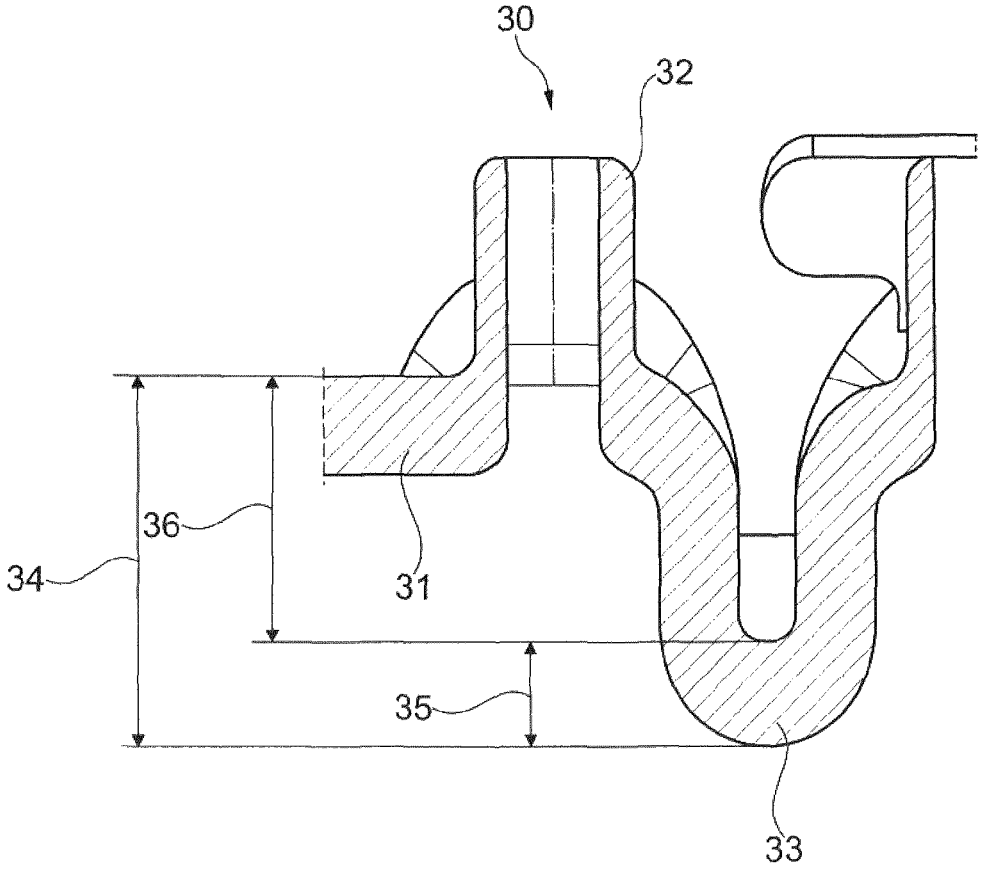
FIG. 7 is a schematic sectional view of a tube sheet, wherein the cross section extends in a direction transverse to the main extension direction of the webs or the openings.

FIG. 7 shows a schematic sectional view through a passage 32 of a tube sheet 30, having a web 33 arranged adjacent thereto. In the sectional view, the web 33 is formed as a U-shaped area which is open towards the top. The view in FIG. 7 hereby corresponds to a cross-section which is transverse to the main extension direction of the webs 4 from FIG. 2, wherein the cross-section is guided through the tube sheet 30 that is positioned directly adjacent to the first wall 6.

FIG. 7 particularly shows that the maximum interior depth 36 of a bead in the web 33 is derived from the maximum material deflection 34, downward from the plane of the base region 31, less the material thickness 35 of the tube sheet 30.

The features shown in FIGS. 1 to 7 can be individually and mutually combined. In respect of the design of the tube sheets or the beads, the passages or the webs, no restrictive effects result from FIGS. 1 to 7. The figures serve to clarify the inventive idea. In particular, the geometry, the number, and the measurements of the beads are solely exemplary.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A tube sheet comprising:

a circumferential edge region for connection to a cover of a collecting tank;

a base region with openings for accommodating tube ends, the base region having webs provided between adjacent openings, the webs connecting portions of the circumferential edge region situated on mutually opposing longitudinal sides; and at least one bead that extends from the circumferential edge region with a limited extension only into one portion of the web, wherein the circumferential edge region has a U-shaped cross-section formed by a first wall, a second wall and a base, wherein the first wall opposes the second wall, wherein the at least one bead has a region of constant depth, a base of the at least one bead, at the region of constant depth, being planar, wherein the tube sheet is provided with three parallel planes, the base of the circumferential edge region forming a first one of the three parallel planes, the base of the at least one bead, at the region of constant depth, forming a second one of the three parallel planes and the web forming a third one of the three parallel planes, wherein the third one of the three parallel planes is an uppermost plane of the three parallel planes and the first one of the three parallel planes is a lowermost plane of the three parallel planes, and wherein, a side of the first one of the three parallel planes is connected to a first side of the second one of the three parallel planes by a first obliquely extending transition and a second side of the second one of the three parallel planes is connected to a side of the third one of the three parallel planes by a second obliquely extending transition, and wherein the first obliquely extending transition is a portion of the first wall.

2. The tube sheet according to claim 1, wherein the openings are elongated and extend parallel to one another.

3. The tube sheet according to claim 1, wherein the openings each have an at least partially circumferential wall that projects in a direction of an open end region of the U-shaped circumferential edge region from the base region.

4. The tube sheet according to claim 3, wherein the at least partially circumferential wall has bevels at longitudinal end regions thereof that face the first wall of the U-shaped circumferential edge region.

5. The tube sheet according to claim 1, wherein the at least one bead is molded into the tube sheet from above, from the direction of an open end region of the U-shaped circumferential edge region.

6. The tube sheet according to claim 1, wherein the at least one bead extends from the first wall to the web.

7. The tube sheet according to claim 1, wherein the at least one bead is arranged at each of two mutually opposing end regions of each of the webs.

8. The tube sheet according to claim 1, wherein a depth of the at least one bead decreases with increasing distance from the first wall of the circumferential edge region.

9. The tube sheet according to claim 1, wherein the at least one bead has an extension in an area of the first wall, which extends beyond the extension of the web in a direction transverse to a main extension direction of the web.

10. The tube sheet according to claim 1, wherein a maximum interior depth of the at least one bead is determined by a maximum material deflection from the base region, less an applied material thickness.

11. A heat exchanger comprising a plurality of tubes, which ends are accommodated in tube sheets, wherein at least one of the tube sheets is the tube sheet according to claim 1.

12. The tube sheet according to claim 1, wherein the at least one bead opens directly into the circumferential edge region.

* * * * *